US010197263B2

(12) United States Patent
Yeung

(10) Patent No.: US 10,197,263 B2
(45) Date of Patent: Feb. 5, 2019

(54) OMNIDIRECTIONAL LIGHT EMISSION LED LAMP

(71) Applicant: GEAN LIGHTING CO., LIMITED, Wanchai, Hong Kong (CN)

(72) Inventor: Chiwai Yeung, Hong Kong (CN)

(73) Assignee: GEAN LIGHTING CO., LIMITED, Wanchai, Hong Kong (CN)

( * ) Notice: Subject to any disclaimer, the term of this patent is extended or adjusted under 35 U.S.C. 154(b) by 118 days.

(21) Appl. No.: 15/519,451

(22) PCT Filed: Oct. 14, 2015

(86) PCT No.: PCT/CN2015/000695

§ 371 (c)(1),
(2) Date: Apr. 14, 2017

(87) PCT Pub. No.: WO2016/058286

PCT Pub. Date: Apr. 21, 2016

(65) Prior Publication Data

US 2017/0234521 A1 Aug. 17, 2017

(30) Foreign Application Priority Data

Oct. 17, 2014 (CN) ..... 2014 1 0552841

(51) Int. Cl.
*F21V 29/83* (2015.01)
*F21V 19/00* (2006.01)
(Continued)

(52) U.S. Cl.
CPC ..... *F21V 29/83* (2015.01); *F21K 9/232* (2016.08); *F21K 9/235* (2016.08); *F21K 9/238* (2016.08);
(Continued)

(58) Field of Classification Search
CPC ... F21V 29/83; F21V 3/00; F21V 3/02; F21V 7/22; F21V 19/00; F21V 21/00;
(Continued)

(56) References Cited

U.S. PATENT DOCUMENTS 8,616,714 B2 * 12/2013 Lee ..... F21V 29/713 313/46
9,030,120 B2 * 5/2015 Pickard ..... F21V 29/767 315/291
(Continued)

FOREIGN PATENT DOCUMENTS

CN 101532609 9/2009
CN 102022651 4/2011
(Continued)

OTHER PUBLICATIONS

International Search Report issued in the corresponding PCT Application No. PCT/CN2015/000695, dated Jan. 21, 2016, 6 pages.

*Primary Examiner* — Alan B Cariaso
(74) *Attorney, Agent, or Firm* — Hamre, Schumann, Mueller & Larson, P.C.

(57) ABSTRACT

An omnidirectional light emission LED lamp, comprising an electrical connector, a connecting piece, at least two translucent cover and LED light-emitting elements fixed on the translucent covers. The plurality of translucent covers interconnects and encloses into an overall lampshade shape, and a channel is enclosed between the translucent covers. Openings at the two ends of the channel are in communication with the outside, the connecting piece is fixed on the translucent covers at least one end of the channel, a cavity is formed within the connecting piece, the cavity is in communication with the channel, and ventilation holes in communication with the outside are provided on the connecting piece. The LED lamp implements 360 degree omnidirectional illumination, and has high light-emitting effi-
(Continued)

ciency, good heat dissipation performance and a long service life. In addition, lampshades having various lengths and shapes may be assembled according to requirements, processing is facilitated, and the range of applications is wide.

8 Claims, 4 Drawing Sheets

(51) Int. Cl.

| | |
|---|---|
| ***F21V 3/00*** | (2015.01) |
| ***F21K 9/66*** | (2016.01) |
| ***F21S 2/00*** | (2016.01) |
| ***F21V 21/00*** | (2006.01) |
| ***F21K 9/238*** | (2016.01) |
| ***F21K 9/232*** | (2016.01) |
| ***F21K 9/235*** | (2016.01) |
| ***F21V 3/02*** | (2006.01) |
| ***F21V 7/22*** | (2018.01) |
| ***F21V 23/00*** | (2015.01) |
| ***F21V 23/06*** | (2006.01) |
| *F21Y 115/10* | (2016.01) |

(52) U.S. Cl.
CPC ..... *F21K 9/66* (2016.08); *F21S 2/00* (2013.01); *F21V 3/00* (2013.01); *F21V 3/02* (2013.01); *F21V 7/22* (2013.01); *F21V 19/00* (2013.01); *F21V 21/00* (2013.01); *F21V 23/003* (2013.01); *F21V 23/06* (2013.01); *F21Y 2115/10* (2016.08)

(58) Field of Classification Search
CPC ..... F21V 23/003; F21V 23/06; F21K 9/232; F21K 9/235; F21K 9/238; F21K 9/66; F21S 2/00
See application file for complete search history.

(56) References Cited

U.S. PATENT DOCUMENTS

| | | | | |
|---|---|---|---|---|
| 9,500,355 | B2 * | 11/2016 | Kuenzler | F21V 7/048 |
| 2014/0340899 | A1 * | 11/2014 | Bailey | F21V 23/006 362/245 |
| 2015/0077994 | A1 * | 3/2015 | Wang | F21V 29/77 362/241 |

FOREIGN PATENT DOCUMENTS

| | | |
|---|---|---|
| CN | 102900981 | 1/2013 |
| CN | 103244933 | 8/2013 |
| CN | 203131507 | 8/2013 |
| CN | 104295968 | 1/2015 |
| CN | 204284986 | 4/2015 |
| WO | 2014069183 | 5/2014 |

* cited by examiner

OMNIDIRECTIONAL LIGHT EMISSION LED LAMP

TECHNICAL FIELD

The present invention relates to an LED lamp, more specifically, to an omnidirectional light emission LED lamp.

BACKGROUND

In recent years, various performance of the illuminating LED lamp has been improved considerably due to the continuous development of the LED technology. The LED lamp has become the trend in the future of the light source since it has a number of advantages such as long lifetime, high luminous efficiency, no UV radiation and lower energy consumption.

However, unlike the incandescent lamp and the like which could implement 360 degree omnidirectional illumination, the LED light source has directivity, so its illuminating effect, to a certain extent, is impacted when it replaces traditional light source such as the incandescent lamp or the like as a light source, especially when the LED is manufactured to be a daylight lamp having a traditional tube-shape, for example the "LED daylight lamp" disclosed in the Chinese patent publication number CN102022651A. This LED daylight lamp comprises a lampshade, LED light source components, an LED driving component, two end caps and a heat dissipating housing. The lampshade is connected to the heat dissipating housing, and the two end caps cover the lampshade and the heat dissipating housing which have been connected at their two ends respectively. The cross sections of the lampshade and the heat dissipating housing are both arc-shaped, and the lampshade and the heat dissipating housing form a chamber in which the LED light source components and the LED driving component are located. In this LED daylight lamp, the LEDs have to be arranged within a plane so as to meet the requirements for their heat dissipation. Thus, its light emitting area could merely cover 180 degree rather than 360 degree (i.e., it emits light from a plane instead of emitting light omnidirectionally), although it has a long straight tube-shape like the daylight lamp. Therefore, the LED daylight lamp in the prior art could not implement 360 degree omnidirectional illumination while meeting the requirements for the heat dissipation since the heat dissipating area and the light emitting area are contradictory.

SUMMARY

The present invention aims to solve the problem of providing an LED lamp that could implement omnidirectional illumination as well as has good heat dissipation performance.

In order to solve the technical problem mentioned above, the present invention provides technical solutions as follows. An omnidirectional light emission LED lamp, comprising an electrical connector with a driver therein, a connecting piece connected to the electrical connector and translucent covers connected to the connecting piece, is characterized in that: the translucent covers include at least two translucent covers, and the plurality of translucent covers interconnect and enclose into an overall lampshade shape; a channel is enclosed between the translucent covers, openings at the two ends of the channel are in communication with the outside, the connecting piece is fixed on the translucent covers at at least one end of the channel, a cavity is formed within the connecting piece, the cavity of the connecting piece is in communication with the channel between the translucent covers, and ventilation holes in communication with the outside are provided on the connecting piece; and the translucent covers have LED light-emitting elements fixed on them, the light-emitting surfaces of the LED light-emitting elements face to a chamber formed by the translucent covers, and the LED light-emitting elements are connected to the driver in the electrical connector through connecting lines.

Preferably, in order to facilitate the fixing, the portion of the translucent cover that encloses the channel has a gap in which a light-emitting plate is fixed, and the LED light-emitting elements are fixed on the Light-emitting plate.

In one embodiment of the present invention, the translucent covers are fixed and connected to the connecting at one end of the channel, the connecting piece is fixed to the top end of the electrical connector, the translucent covers are connected to the top of the connecting piece, the translucent covers enclose into a bulb shape, the top of the connecting piece has a through-hole in communication with the channel, and the ventilation holes are provided on the side surface of the connecting piece.

Preferably, the connecting piece comprises: a connecting portion connected to the electrical connector; a bottom cap fixed on the connecting portion and separating the electrical connector 1 from the cavity within the connecting piece; and a top cap connected to the bottom cap to form a cavity. The ventilation holes are provided on the side circumferential surface of the bottom cap and arranged evenly spaced along the circumferential surface. The through-hole is provided on the top cap.

In order to facilitate fixing, the top cap is provided with a stop plate extending upward along the periphery of the through-hole, the top cap is also provided with a positioning plates fixed outside the stop plate and separated from the stop plate with a space, the bottom of the translucent covers is locked and fixed into the space between the stop plate and the positioning plate.

In another embodiment of the present invention, the translucent covers enclose a strip tube shape, the both ends of the channel enclosed by the translucent covers are connected and fixed to the connecting pieces, the connecting pieces are hollow cylinder-shaped and comprise two separating plates perpendicular to its axial direction to define the cavity, the side surface of the connecting piece that has the cavity is provided with the ventilation holes, the separating plate at one end of the connecting piece is provided with the through-hole in communication with the channel, and the other end of the connecting piece is provided with pins which are connected to the electrical connector.

In order to improve the light-emitting efficiency and the brightness, the surface of the light-emitting plate that is provided with LED light-emitting elements is coated with a reflective layer.

In order to facilitate the fixing and assembling, the side edges of the gap are provided with grooves for fixing the light-emitting plate.

Compared with the technology in prior art, the present invention has advantages as follows: This LED lamp implements 360 degree omnidirectional illumination with large light-emitting angle and high light-emitting efficiency, and has good heat dissipation performance, thereby increasing the service life of the LED lamp. Additionally, the translucent covers of this LED lamp could be combined into a lampshade with various lengths or various shapes as required, and its processing is facilitated, thereby widening the range of applications of the LED lamp.

DETAILED DESCRIPTION

In the following, further details of the present invention are described with reference to the drawings and embodiments.

Embodiment 1

Figure 1:
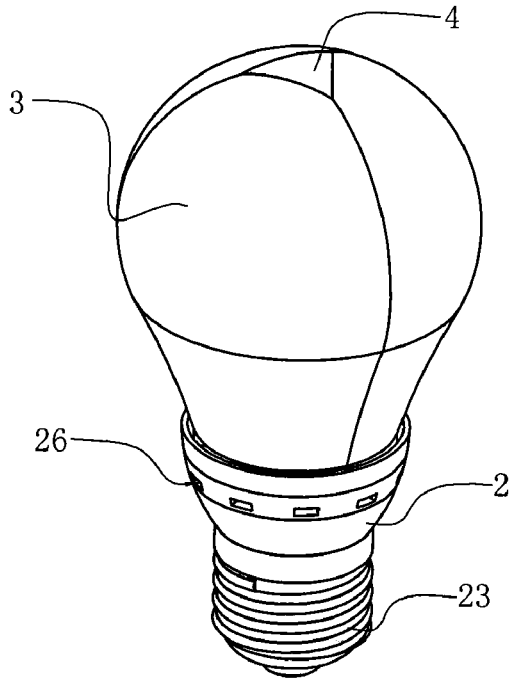
FIG. 1 is a perspective view of the LED lamp according to the first embodiment of the present invention.
Figure 2:
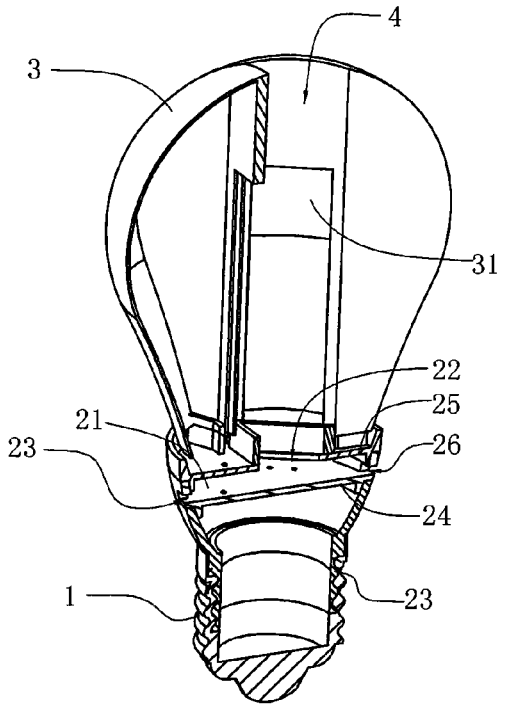
FIG. 2 is a sectional view of the LED lamp according to the first embodiment of the present invention.
Figure 3:
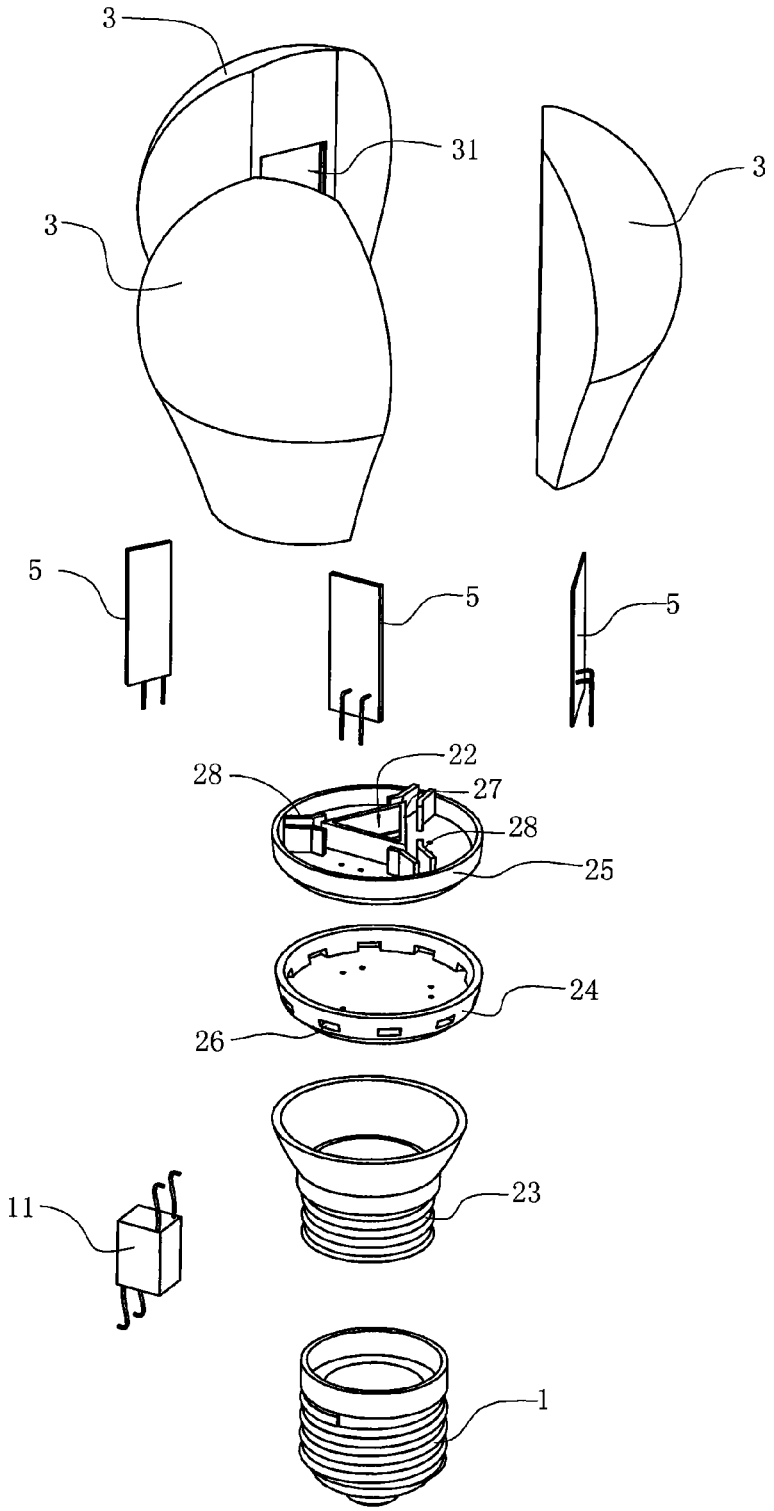
FIG. 3 is an exploded view of the LED lamp according to the first embodiment of the present invention.

As illustrated in FIG. 1 to FIG. 3, the LED lamp according to the first embodiment comprises an electrical connector 1, a connecting piece 2 connected to the electrical connector 1 and translucent covers 3 connected to the connecting piece 2.

The electrical connector 1 is provided with a driver 11 therein. The driver 11 is connected to an external power through the electrical connector 1.

In this embodiment, the connecting piece 2 is connected and fixed to the electrical connector 1 at its bottom, and there is a cavity 21 formed within the connecting piece 2 for ventilation.

At least two translucent cover 3 are fixed and connected to the top of the connecting piece 2. The at least two translucent cover 3 interconnect and enclose into an overall lampshade, and each of the translucent cover 3 has a cavity formed therein. In addition, a channel 4, which extends vertically and has openings in communication with the outside at its both ends, is enclosed between the at least two translucent covers 3.

The bottom of the translucent cover 3 is fixed and connected to the connecting piece 2, i.e., one end of the channel 4 is connected to the connecting piece 2. The connecting piece 2 is provided with a through-hole 22, which connects the channel 4 and the cavity 21, at its top.

And the connecting piece 2 is provided with ventilation holes 26 which is in communication with the outer environment, and the ventilation holes 26 is connect to the cavity 21. Light-emitting plates 5 are fixed to the portions of the translucent covers 3 that enclose the channel 4.

The portions of the translucent cover 3 that enclose the channel 4 are provided with gaps 31 for fixing the light-emitting plates 5. A plurality of LED light-emitting elements are fixed on the side surface of the light-emitting plate 5 that face to the outer surface of the translucent cover 3. The plurality of the LED light-emitting elements are connected to the driver 11 within the electrical connector 1 by the connecting lines through the connecting piece 2.

The side edges of the gap 31 are provided with grooves for fixing the light-emitting plate 5. That is, the light-emitting plates 5 are located on the circumferential surface of the channel 4 and enclose the channel 4. Therefore, the LED light-emitting elements included in the light-emitting plates 5 could implement 360 degree illumination in various directions, such that omnidirectional illumination are realized. The person skilled in the art could understand that the light-emitting plate may also be omitted and the LED light-emitting elements are directly fixed on the surface of the portion of the translucent cover 3 that is close to the channel 4 which faces to the outside of the translucent cover 3. The channel like this and the channel through which a convection between the cavity within the connecting piece and the outside air is formed could implement heat dissipation, such that the heat generated from the plurality of LED light-emitting elements could be transferred out, thereby implementing omnidirectional illumination of the LED lamp and meeting the requirement for its heat dissipation.

The light-emitting plate 5 can be made of transparent material such as glass, ceramic, plastic and the like, or opaque material such as metal. The surface of the light-emitting plate 5 that is provided with LED light-emitting elements is coated with a reflective layer.

The LED light-emitting element may be LED chip or SMD LED, or may be directly formed on the light-emitting body 3 through the processes including attaching powder, bonding dies and bonding wires. Various forms are possible. The LED light-emitting elements may be arranged on the surface of the translucent cover that is close to the channel 4, or may be on the outer surface of the translucent cover as long as their light-emitting surfaces face to the cavity formed by the translucent cover 3.

The connecting piece 2 comprises: a connecting portion 23 connected to the electrical connector 1 by means of screw thread, direct plug-in and the like; a bottom cap 24 fixed on the connecting portion 23 and separating the electrical connector 1 from the cavity 21 within the connecting piece 2; and a top cap 25 connected to the bottom cap 24 to form a cavity 21. The through-hole 22 is provided on the top cap 25. The ventilation holes 26 are provided on the side surface of the connecting piece 2, i.e., the side circumferential surface of the bottom cap 24, and arranged evenly spaced along the circumferential surface. The top cap 25 is provided with a stop plate 27 extending upward along the periphery of the through-hole 22, and positioning plates 28 located outside the stop plate 27 and separated from the stop plate 27 with a space. The positioning plates 28 are fixed on the top cap 25. The stop plate 27 and the positioning plates 28 are used to lock the bottom of the translucent cover 3 into the space between them so as to fix the translucent cover 3 on the top cap 25. The at least two translucent cover 3 according to this embodiment enclose into an integrity with an incandescent lamp shape. The through-hole 22 is a triangular hole. And the number of the translucent covers 3 is three.

Embodiment 2

Figure 4:
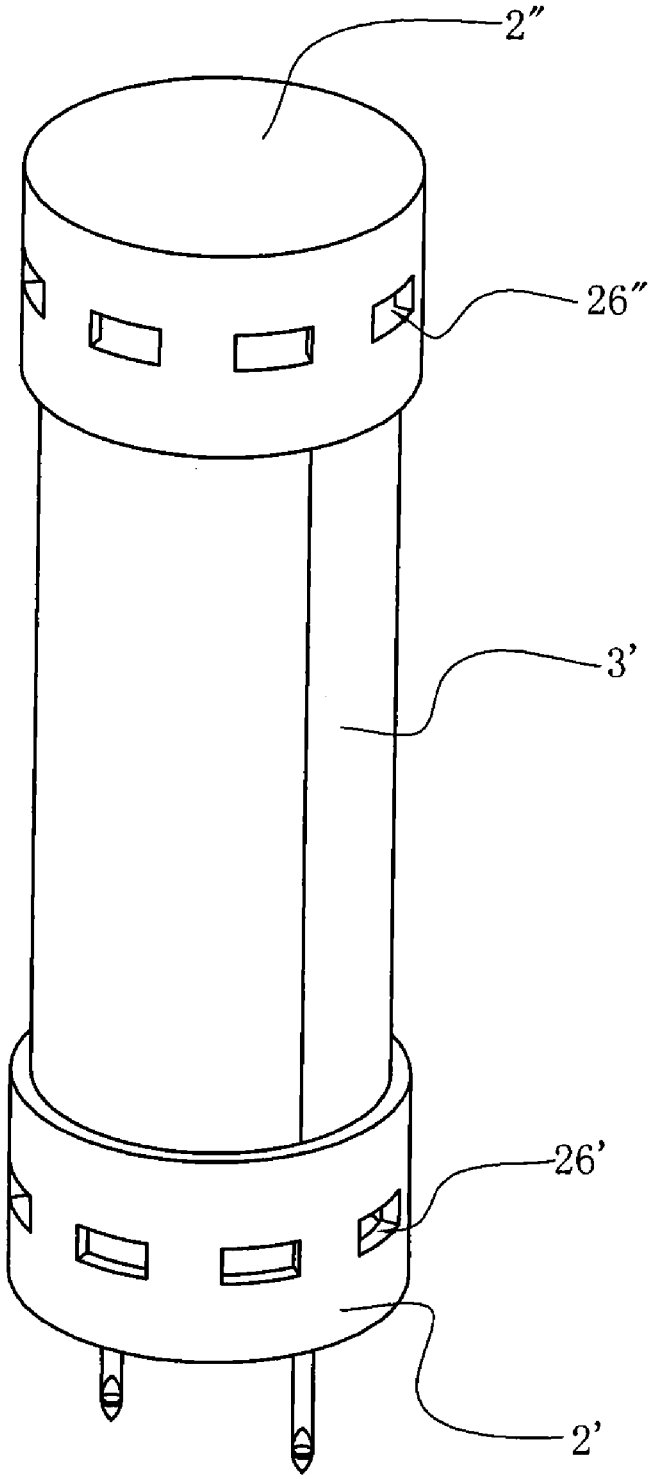
FIG. 4 is a perspective view of the LED lamp according to the second embodiment of the present invention.
Figure 5:
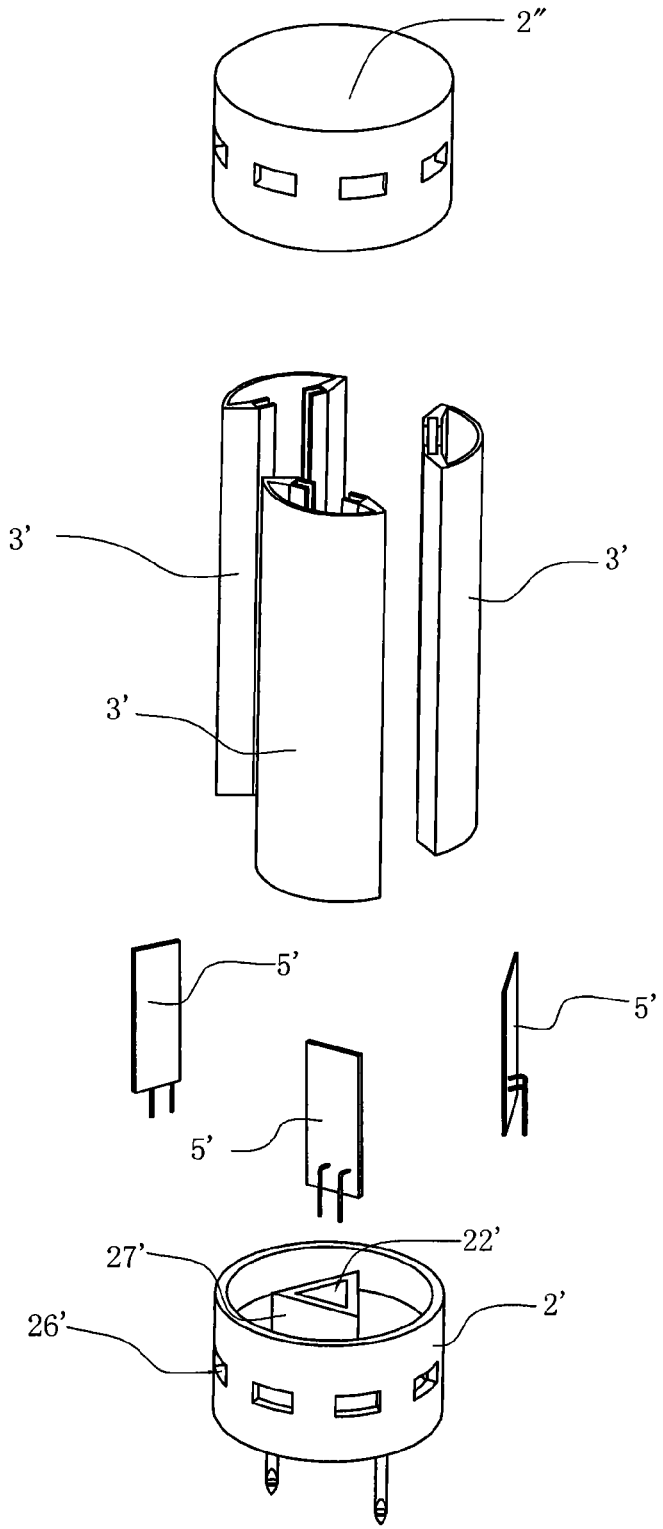
FIG. 5 is an exploded view of the LED lamp according to the second embodiment of the present invention.

FIG. 4 and FIG. 5, omitting the electrical connector, illustrate the second embodiments of the present invention. The connecting piece 2' connected to the electrical connector in this embodiment is hollow cylinder-shaped and provided with two separating plates perpendicular to its axial direction therein to define the cavity 21'. One of the separating plates is provided with a though-hole 22'. The portion of the circumferential surface that corresponds to the cavity 21' is provided with ventilation holes 26'. The ventilation holes 26' are evenly spaced on the portion of the circumferential surface of the connecting piece that corresponds to the cavity 21'. The separating plate with the through-hole 22' is provided with a stop plate 27' protruding upward along the periphery of the through-hole 22' which is used to fix at least two translucent covers 3'. The translucent covers 3' is strip-shaped and has a plane surface at one side and a curved surface with arc-shaped section at the other side. The curved surfaces of the at least two translucent covers 3' join together to form a long cylinder-shaped lampshade. The plane surfaces of the translucent cover 3' join together to enclose a hollow channel 4' extending vertically. The channel 4' has openings at its two ends, and its bottom is fixed to the through-hole 22'. The surface of the translucent cover 3' that faces to the channel 4', i.e., the plane surface, has a light-emitting plate 5' fixed on it. Preferably, this surface has a gap for accommodating the light-emitting plate 5'. The surface of the light-emitting plate 5' that faces outward, i.e., the surface toward the cavity of the translucent cover 3', has a plurality of LED light-emitting elements fixed on it. The LED light-emitting elements are connected to the pins on the connecting piece 2' through connecting lines and thereby connected to the external electrical connector through the pins. The person skilled in the art could understand that the light-emitting plate 5' may be omitted and the LED light-emitting elements may also be directly fixed on the surface of the translucent cover 3' that encloses the channel 4'. The LED light-emitting elements may also be fixed on the outer surface of the translucent cover 3' with the light-emitting surface toward the cavity.

In the present embodiment, one end of the translucent covers 3' are connected to the connecting piece 2', and the other end of the translucent covers 3' are connected to each other and expose the channel 4', or connected to a second connecting piece 2". As illustrated in FIG. 4 and FIG. 5, the second connecting piece 2" also has a cavity like the first connecting piece 2'. One end of the cavity is in communication with the through-hole 22', and the circumferential surface of the cavity has ventilation holes 26" in communication with the outside. The second connecting piece 2" also has connecting line connecting the LED light-emitting elements and the pins thereon. Thereby, the overall LED lamp forms a tube shape with its two ends having pins and could be used as a daylight lamp.

The above LED lamp has at least two translucent covers which joint together to form an integrity, and a channel is formed between the translucent covers. One end of the channel is in communication with the outside through the connecting piece, and the other end is in communication with the outside directly. Alternatively, both ends could be in communication with the outside through the connecting piece to form a channel for convection to dissipate the heat. This LED lamp implements 360 degree omnidirectional illumination with large light-emitting angle and high light-emitting efficiency, and has good heat dissipation performance, thereby increasing the service life of the LED lamp. Additionally, the translucent covers of this LED lamp could be combined into a lampshade with various lengths or various shapes as required, and its processing is facilitated, thereby widening the range of applications of the LED lamp.

Although the preferred embodiments of the present invention have been described above in detail, the person skilled in the art should clearly understand that various modification and alteration to the present invention are possible. Any modification, equivalent replacement and improvement within the spirits and principles of the present invention all fall into the protection scope of the present invention.

The invention claimed is:

1. An omnidirectional light emission LED lamp, comprising an electrical connector with a driver therein, a connecting piece connected to the electrical connector and translucent covers connected to the connecting piece (2), characterized in that:

the translucent covers include at least two translucent covers, and the plurality of translucent covers interconnect and enclose into an overall lampshade shape;

a channel is enclosed between the translucent covers, openings at the two ends of the channel are in communication with the outside, the connecting piece is fixed on the translucent covers at least one end of the channel, a cavity is formed within the connecting piece, the cavity of the connecting piece is in communication with the channel between the translucent covers, and ventilation holes in communication with the outside are provided on the connecting piece; and the translucent covers have LED light-emitting elements fixed on them, the light-emitting surfaces of the LED light-emitting elements face to a chamber formed by the translucent covers, and the LED light-emitting elements are connected to the driver in the electrical connector through connecting lines.

2. The omnidirectional light emission LED lamp according to claim 1, wherein: the portion of the translucent cover that encloses the channel has a gap in which a light-emitting plate is fixed, and the LED light-emitting elements are fixed on the Light-emitting plate.

3. The omnidirectional light emission LED lamp according to claim 1, wherein: the translucent covers are fixed and connected to the connecting piece at one end of the channel, the connecting piece is fixed to the top end of the electrical connector, the translucent covers are connected to the top of the connecting piece, the translucent covers enclose into a bulb shape, the top of the connecting piece has a through-hole in communication with the channel, and the ventilation holes are provided on the side surface of the connecting piece.

4. The omnidirectional light emission LED lamp according to claim 3, wherein: the connecting piece comprises a connecting portion connected to the electrical connector, a bottom cap fixed on the connecting portion and separating the electrical connector from a cavity within the connecting piece, and a top cap connected to the bottom cap to form the cavity, the ventilation holes are provided on the side circumferential surface of the bottom cap and evenly spaced along the circumferential surface, and the through-hole is provided on the top cap.

5. The omnidirectional light emission LED lamp according to claim 4, wherein: the top cap is provided with a stop plate extending upward along the periphery of the through-hole, the top cap is also provided with a positioning plates 28 fixed outside the stop plate and separated from the stop plate with a space, the bottom of the translucent covers are locked and fixed into the space between the stop plate and the positioning plate.

6. The omnidirectional light emission LED lamp according to claim 1, wherein: the translucent covers enclose a strip tube shape, the both ends of the channel enclosed by the translucent covers are connected and fixed to the connecting pieces, the connecting pieces are hollow cylinder-shaped and comprise two separating plates perpendicular to its axial direction to define the cavity, the side surface of the connecting piece that has the cavity is provided with the ventilation holes, the separating plate at one end of the connecting piece is provided with the through-hole in communication with the channel, and the other end of the connecting piece is provided with pins which are connected to the electrical connector.

7. The omnidirectional light emission LED lamp according to claim 2, wherein: the surface of the light-emitting plate that is provided with LED light-emitting elements is coated with a reflective layer.

8. The omnidirectional light emission LED lamp according to claim 2, wherein: the side edges of the gap are provided with grooves for fixing the light-emitting plate.

* * * * *